US005111958A

United States Patent [19]

Witthoeft

[11] Patent Number: 5,111,958

[45] Date of Patent: May 12, 1992

[54] COMPARTMENTALIZED REFUSE COLLECTION UNIT

[76] Inventor: Carol A. Witthoeft, 890 Western St., Hoffman Estates, Ill. 60194

[21] Appl. No.: 716,095

[22] Filed: Jun. 17, 1991

[51] Int. Cl.[5] ..... B65D 90/04

[52] U.S. Cl. ..... 220/524; 220/408; 220/909; 220/23.83; 220/505; 220/94 A

[58] Field of Search ..... 220/524, 408, 909, 23.83, 220/505, 94 A

[56] References Cited

U.S. PATENT DOCUMENTS

| | | | |
|---|---|---|---|
| 247,316 | 9/1881 | Crane | 220/524 |
| 386,964 | 7/1888 | Cochran | 220/505 X |
| 1,656,072 | 1/1928 | Lukens | 220/94 A |
| 1,933,894 | 11/1933 | Clink | 220/524 X |
| 2,051,006 | 8/1936 | Marcus | 220/94 A |
| 3,429,474 | 2/1969 | Cann | 220/524 X |
| 3,720,346 | 3/1973 | Cypher | 220/909 X |
| 3,820,656 | 6/1974 | Orr | 220/505 X |
| 3,887,103 | 6/1975 | Spooner | 220/94 AX |
| 4,114,776 | 9/1978 | Piuss | 220/909 X |
| 4,801,034 | 1/1989 | Sandomeno | 220/909 X |
| 4,834,253 | 5/1989 | Crine | 220/909 X |
| 4,878,592 | 11/1989 | Lee | 220/408 X |
| 4,893,719 | 1/1990 | Lombardi et al. | 220/909 X |
| 4,974,746 | 12/1990 | Dickinson | 220/23.83 X |
| 5,018,637 | 5/1991 | Miller | 220/94 AX |
| 5,046,635 | 9/1991 | Haas et al. | 220/408 X |

*Primary Examiner*—Stephen P. Garbe
*Assistant Examiner*—Paul A. Schwarz
*Attorney, Agent, or Firm*—Rudolph L. Lowell; Brian J. Laurenzo

[57] ABSTRACT

A refuse collection unit for household use comprising a container body defining a first storage area adapted to receive at least a conventional plastic refuse bag therein and a second storage area adapted to receive at least two removable rigid liners in a side-by-side disposition therein. The removable liners are each used to store a particular type of recyclable refuse material therein, and the conventional plastic refuse bag for storage of non-recyclable refuse. The liners include a bottom wall, three liner walls and an upwardly stepped fourth wall. Hand-gripping elements are provided on each of said liners. The first storage area rises higher than the second storage area for easy recognition of the areas. In addition, a pair of hinged cover members are provided, one for the first storage area and the other for the second storage area. A third liner may be placed in the first storage area to occupy substantially one-half of said first storage area.

9 Claims, 5 Drawing Sheets

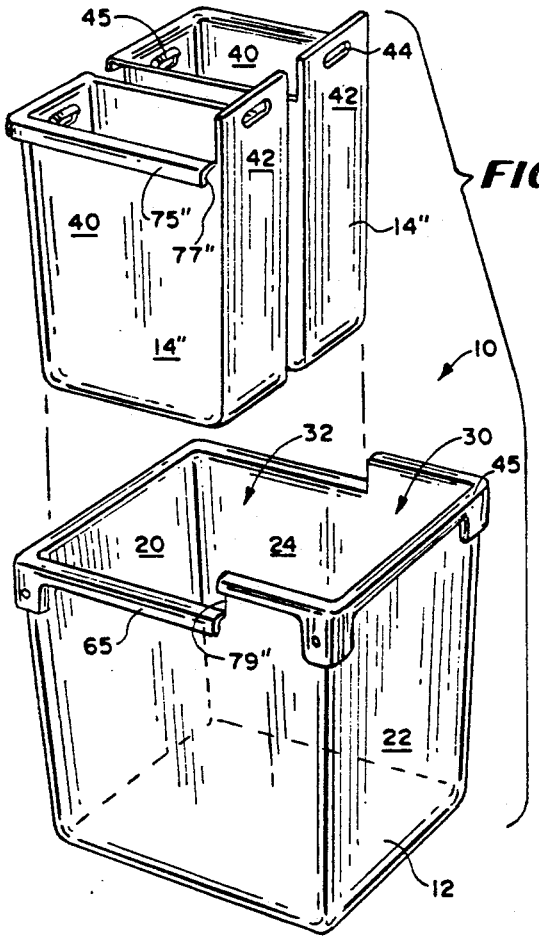
FIG. 12
FIG. 14
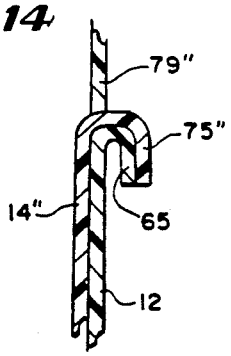
FIG. 15
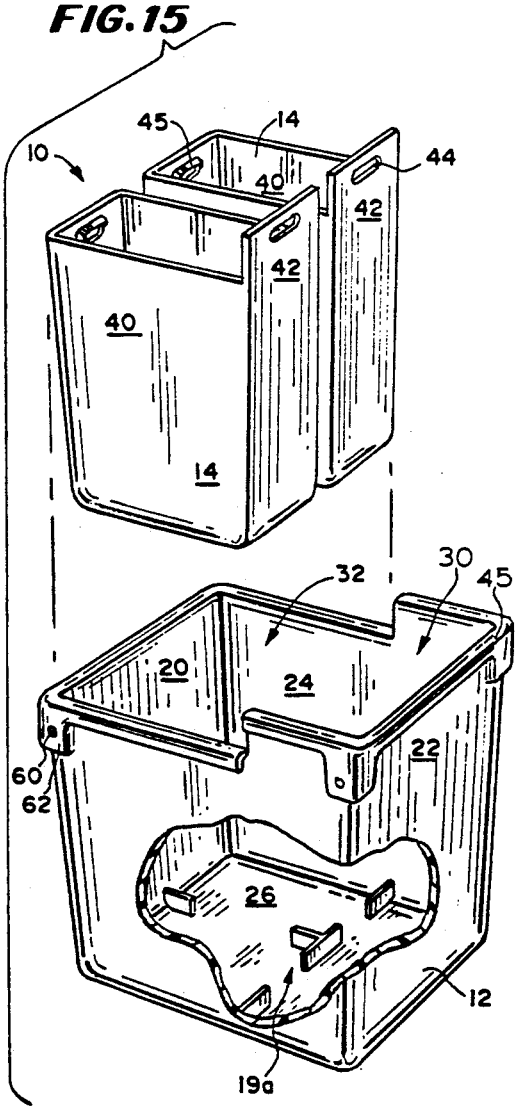
FIG. 13
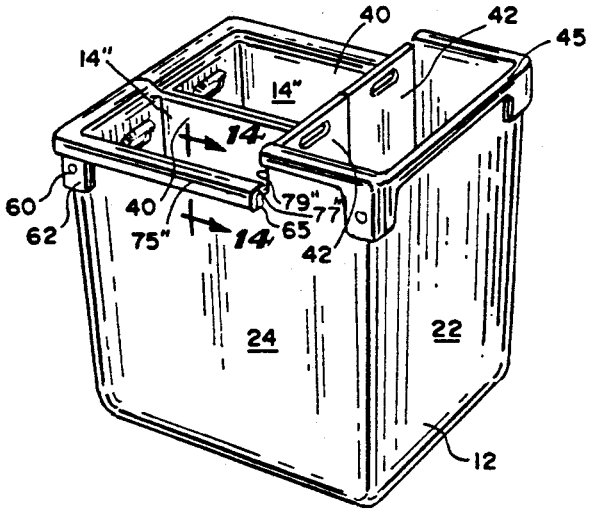

COMPARTMENTALIZED REFUSE COLLECTION UNIT

BACKGROUND OF THE INVENTION

The present invention relates generally to refuse collection units and, more particularly, to a collection unit within which segregation of differing types of refuse is possible.

In light of public awareness for the need to recycle certain types of refuse, increasing efforts have been made by municipalities and private organizations to facilitate recycling of various types of refuse, such as aluminum items, glass materials, paper materials and plastic materials, by offering services to collect such items on a regular basis. One of the drawbacks, however, is that each of the various types of recyclable refuse materials must be segregated from the nonrecyclable refuse as well as one from the other, prior to collection. As a result, the burden of segregating the various types of recyclable refuse materials usually rests upon the individual members of the public.

Various attempts have been made to provide containers having separate compartments for segregation of recyclable and nonrecyclable materials. None of these attempts, however, provide a container for household use which is aesthetic and which has easily identified separate compartments for convenient and easy segregation, storage and disposal of both recyclable and nonrecyclable refuse.

For example, such compartmentalized refuse containers are disclosed in the following U.S. patents:

| U.S. Pat. No. | Patentee |
|---|---|
| 3,720,346 | Cypher |
| 4,114,776 | Piuss |
| 4,801,034 | Sandomeno |
| 4,834,253 | Crine |
| 4,878,592 | Lee |
| 4,893,719 | Lombardi et al. |

Accordingly, it is an object of this invention to provide a household refuse collection unit adapted for receiving and storing various types of recyclable refuse materials and nonrecyclable refuse materials therein in a segregated manner. It is a further object of this invention to provide a refuse collection unit which is suitable for household use and which provides a convenient way to segregate and dispose of the refuse as part of the normal household activity. Another object of this invention is to provide a novel refuse collection unit having one storage area for the segregated storage of various recyclable materials and a second storage area for the storage of nonrecyclable refuse, each storage area being readily identifiable. Another object of this invention is to provide a novel refuse collection unit providing for easy removal of the refuse therefrom.

SUMMARY OF THE INVENTION

According to the invention, there is provided a refuse collection unit having an interior area which is adapted to receive and store nonrecyclable refuse and various types of recyclable refuse therein in a segregated manner. The refuse collection unit comprises an outer container which defines a first storage area and a second storage area therein. The first storage area is adapted to receive and store nonrecyclable refuse therein and the second storage area is adapted to receive and store the recyclable refuse therein in a manner separating the various types one from the other. In order to separately receive and store within the second storage area the various recyclable refuse materials, a plurality of rigid liners is provided which can be inserted into and removed from the second storage area easily. Each liner may be separately removed from the container for disposal of its contents. The two liners are generally rectangular and are adapted to be disposed within the second storage area in a side-by-side relation. In addition, the first storage area of the container is adapted to removably secure a conventional plastic refuse bag therein for storing and easy removal of nonrecyclable refuse. The structure of the outer container is such that the first and second storage areas can be easily distinguished from one another by their respective heights.

In addition, the liners are constructed to facilitate their easy removal from the outer container and to complete definition of the first storage area. The liner back wall extends to the same height as the outer container back wall so that, when the liners are in place, the first storage area is defined between the liner back wall and the container back wall. Further, gripping elements are located on a back wall of the liner and an opposing wall.

Two covers are also provided for the unit, one to cover each storage area. Finally, the container and liners may be of specific dimensions to provide further convenience to the user and further environmental advantages. For example, the liners may be sized to accommodate conventional paper grocery bags. Thus, grocery bags, which may be recyclable products, can be used to line the liners for sanitary purposes and to further facilitate the disposal of the contents of the liners. In addition, the container dimensions could be such that the first storage area would readily accept a conventional plastic refuse bag therein for storage of nonrecyclable refuse.

The foregoing invention, and its advantages, may be more readily appreciated from the following detailed description of the preferred embodiment, when read in conjunction with the following drawings.

BRIEF DESCRIPTION OF THE DRAWINGS

FIG. 12 is an exploded perspective view of the unit of FIG. 1 showing rigid liners of the unit in a second embodiment thereof.

FIG. 13 is a perspective view of the embodiment shown in FIG. 12.

FIG. 14 is an enlarged side view of an area of engagement of a liner lip with a lip of the unit container and is taken along line 14—14 of FIG. 13.

FIG. 15 is an exploded perspective view of the unit of FIG. 1 with portions broken away to show an alternate embodiment of the risers of the unit.

DESCRIPTION OF THE PREFERRED EMBODIMENT

Figure 1:
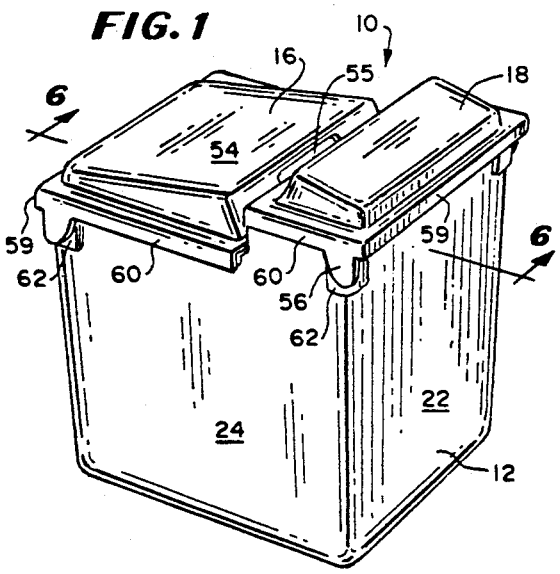
FIG. 1 is a perspective view of the compartmentalized refuse collection unit of the present invention.
Figure 2:
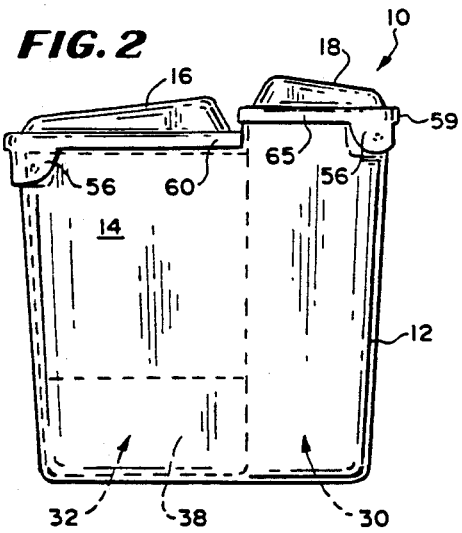
FIG. 2 is a side view of the unit of FIG. 1 and shows a rigid liner thereof in phantom seated within a riser defined space within a second compartment of the unit, one riser also being shown in phantom.

Throughout the various embodiments disclosed herein, like structures have been given similar reference numerals for ease in reading.

Figure 4:
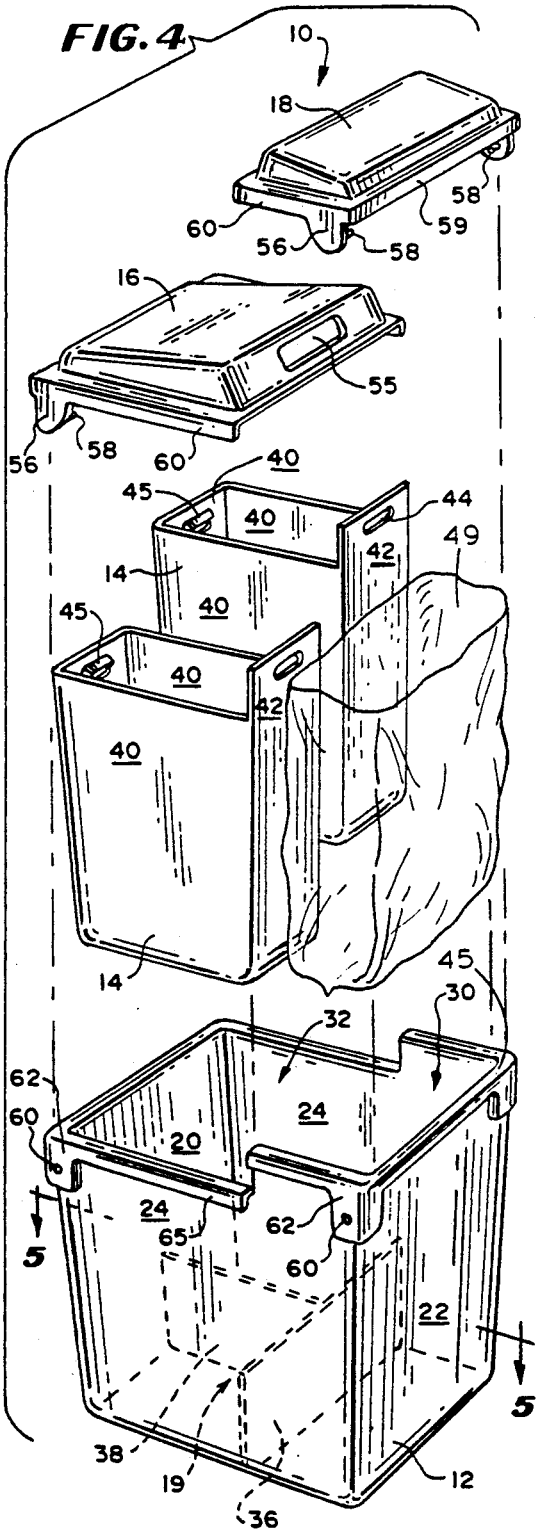
FIG. 4 is an exploded perspective view showing all structures of the collection unit of FIG. 1.
Figure 5:
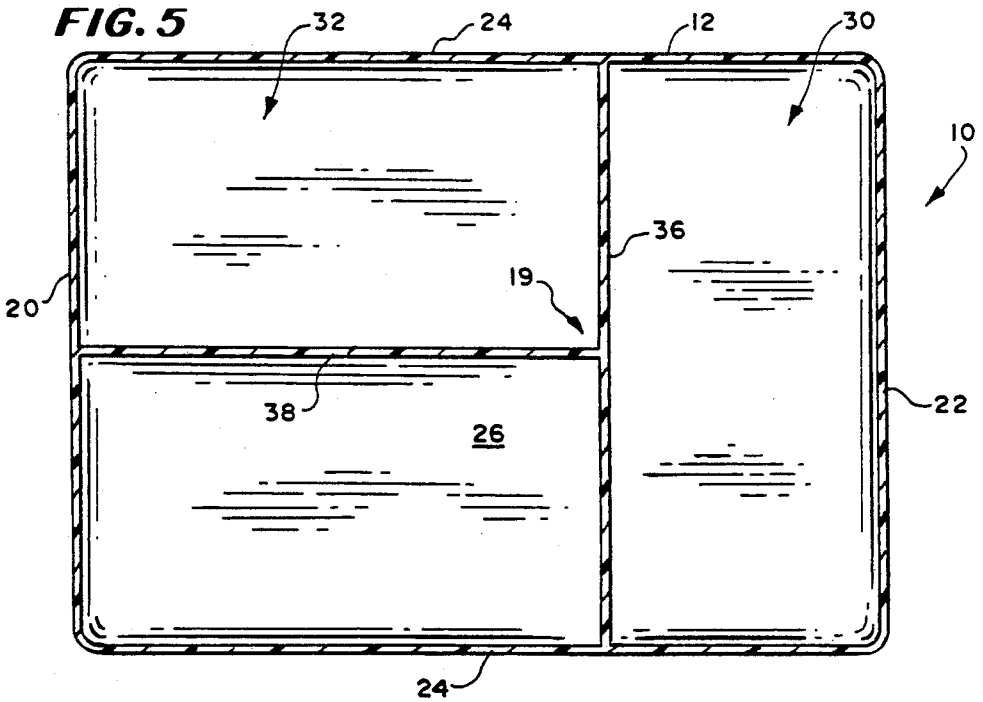
FIG. 5 is a top plan view of the collection unit with the covers removed therefrom and is taken along line 5—5 of FIG. 4.
Figure 6:
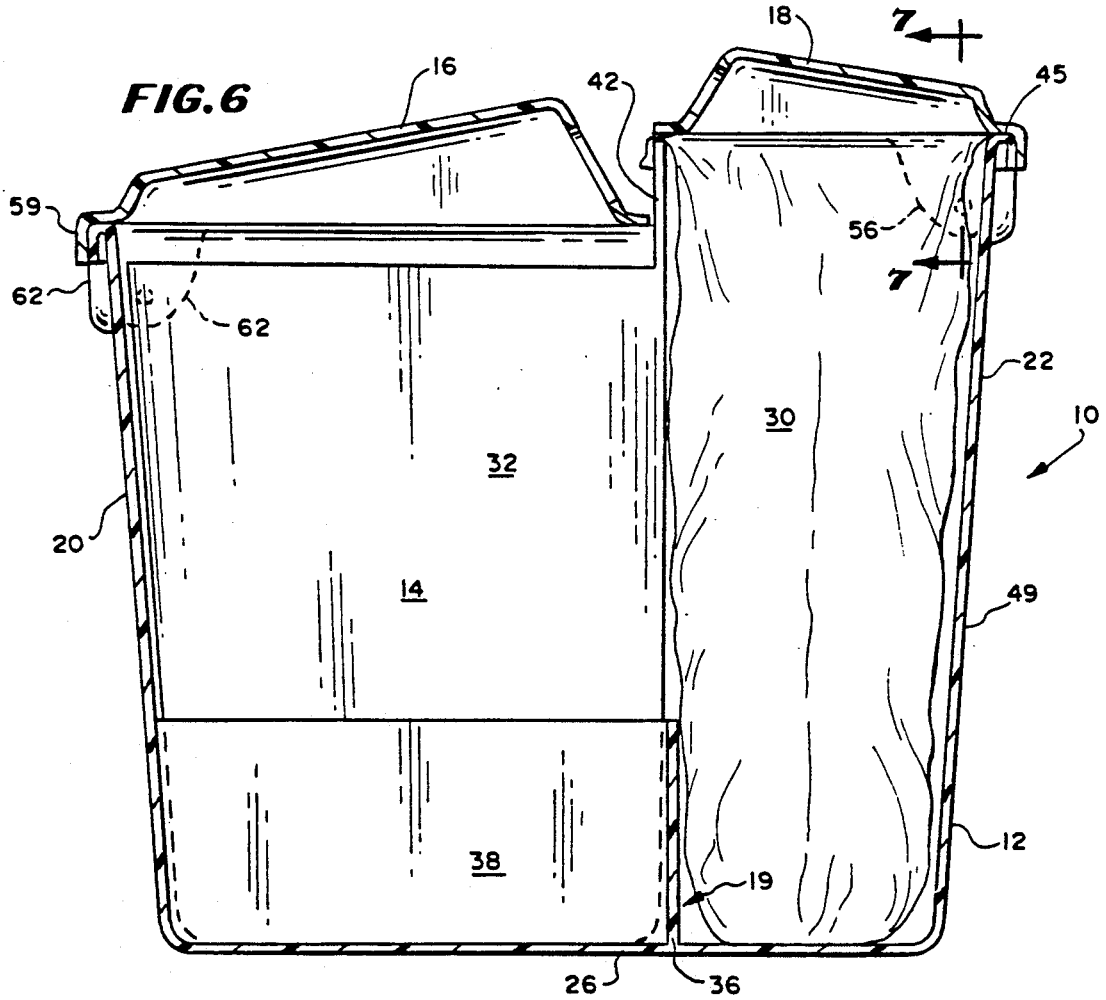
FIG. 6 is a cross-sectional view through the collection unit and is taken along line 6—6 of FIG. 1.

A novel refuse collection unit 10 made in accordance with the teachings of the present invention is shown in the Figures and is generally identified by the reference numeral 10. The unit 10 comprises an outer container 12, a plurality of liners 14, a first cover 16 and a second cover 18 and, if desired, a riser system 19 within the container 12 for assuring appropriate seating of the rigid liners 14 within the container 12. The container 12, liners 14, covers 16 and 18 and riser system 19 may be constructed of any suitable material, such as polyurethane or a comparable plastic. As shown in FIG. 4, container 12 includes a front wall 20, a higher back wall 22, a pair of stepped side walls 24 and bottom wall 26. Back wall 22 and the upwardly stepped portions of the side walls 24 define a first storage area therebetween with the remainder of the interior of the container 12 defining a second storage area 32.

Extending approximately 6 inches upwardly from the bottom wall 26 is the riser system 19 which comprises a first divider 36 and a second divider 38 in one embodiment thereof.

First divider 36 extends across the bottom wall 26 to divide the first storage area 30 from the second storage area 32. Second divider 38 extends across the bottom wall 26 from the bottom center of the front wall 20 to the bottom center of the first divider 36 to define two separate areas in second storage area 32, each of which accommodates one of the liners 14.

Each liner 14 is comprised of three liner walls 40 and upwardly stepped back wall 42 which extends to the same height as back wall 22 of container 12. When the liners 14 are in place within the container 12, the upwardly stepped walls 42 are positioned centrally within the container 12 and provide a boundary to the second storage area 32. A pair of gripping means 44 are shown to comprise horizontal elongate apertures 44 are provided on each liner 14. Preferably, one aperture 44 is formed on stepped wall 42 near its upper end, and the other is formed on a liner wall 40 opposite the stepped wall 42 near its upper end. This aperture 44 may be provided with an inwardly extending collar 45 to aid in grasping inasmuch as the aperture 44 lies flush against the container 12 in this area. The gripping means 44 as defined allow the liners 14 to be easily lifted from within the container 12 for disposal of the content thereof. The container 12 and rigid liners 14 may be dimensioned to provide even more convenience. For example, the liners 14 may be dimensioned to accommodate a conventional paper grocery bag (not shown) to aid in removing the content of the liners 14.

In this regard, the use of paper products is encouraged with reference to recycling efforts. To accomplish this objective, desired dimensions for each liner 14 are approximately 6½ inches in width, 12 inches in length and approximately 18½ inches in height.

In addition, the container 12 may be dimensioned so that the first storage readily accommodates a conventional plastic refuse bag 49. To accomplish this objective, desirable dimensions for the first storage area 30 are 7 to 8 inches in width, approximately 15 inches in length, and approximately 22 inches in height. The plastic trash bag may be removably secured to contiguous surfaces 45 of back wall 22 and side walls 24 of container 12 as will be described in greater detail hereinafter.

Figure 8:
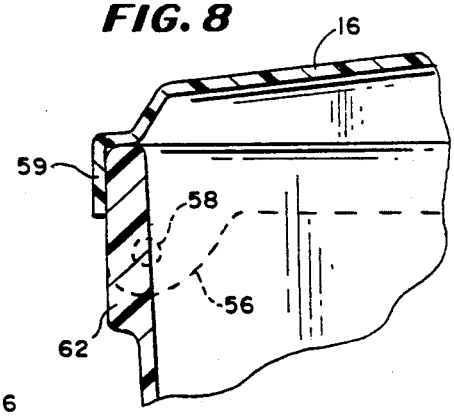
FIG. 8 is a side view of the area shown in FIG. 7 with the cover in a closed position thereof.

First cover 16 and second cover 18 are provided to keep the refuse within the unit 10 out of sight, to help contain odors within the container 12 and to keep insects from entering the container 12. In this regard, separate covers 16 and 18 are proposed to provide access to either first storage area 30 or second storage area 32 without opening of the other storage area. Except for dimensions, first cover 16 and second cover 18 are identical in construction and each comprises a raised cover portion 54, including a handhold 55, a pair of opposed depending side corner flaps 56, an inwardly extending stud 58 located on each side flap 56, a rear lip portion 59 and side lip portions 60. The rear lip portion 59 serves as a stop member so the cover 16, 18 only pivots to the position shown in FIGS. 3, 8 and 9.

Figure 7:
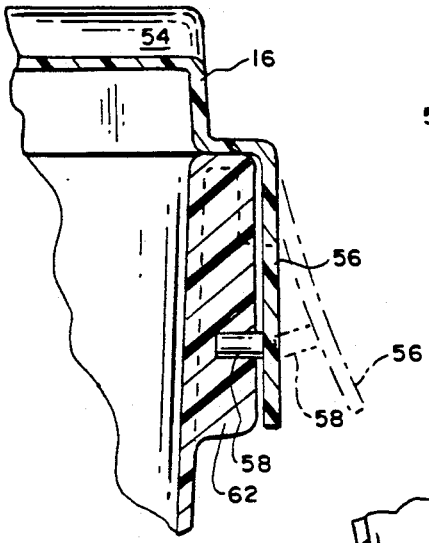
FIG. 7 is an enlarged view of one hinge area of the unit and shows the manner of engagement of one cover to the unit and is taken along line 7—7 of FIG. 6.

To install the covers 16 and 18 on to the container 12, the flaps 56 are outwardly flexed and the studs 58 are inserted into apertures 60 created in vertical corner bosses 62 of the container 12 as shown in FIG. 7.

It will be understood that the covers 16 and 18 are maintained at different vertical levels because of the stepped configuration of the container 12. Further, because the back walls 42 of each of the liners extend to a height equal to the height of the rear wall 22 of the container 12, they serve as a support for a forward edge 63 of the cover 18 which is elevated above cover 16.

Figure 3:
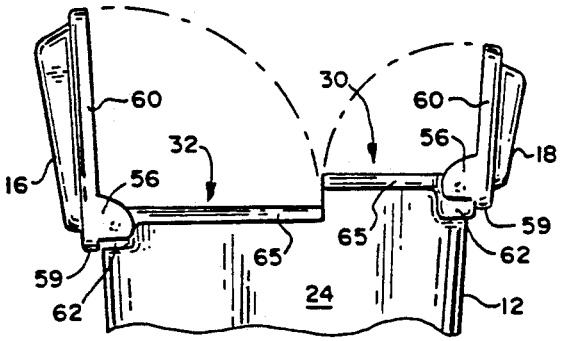
FIG. 3 is a side view of an upper portion of the unit showing the covers thereof in a raised or open position thereof.
Figure 9:
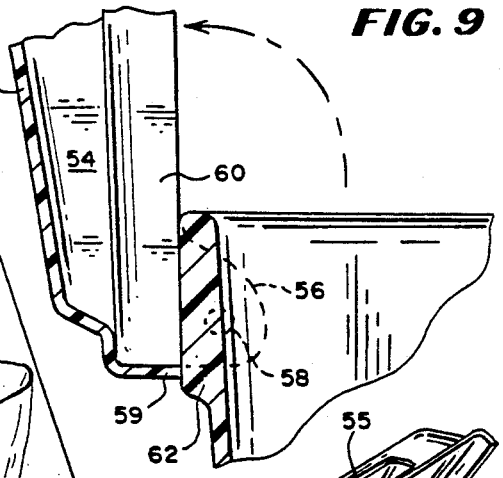
FIG. 9 is a view similar to FIG. 8 but showing the cover in an open position thereof.
Figure 10:
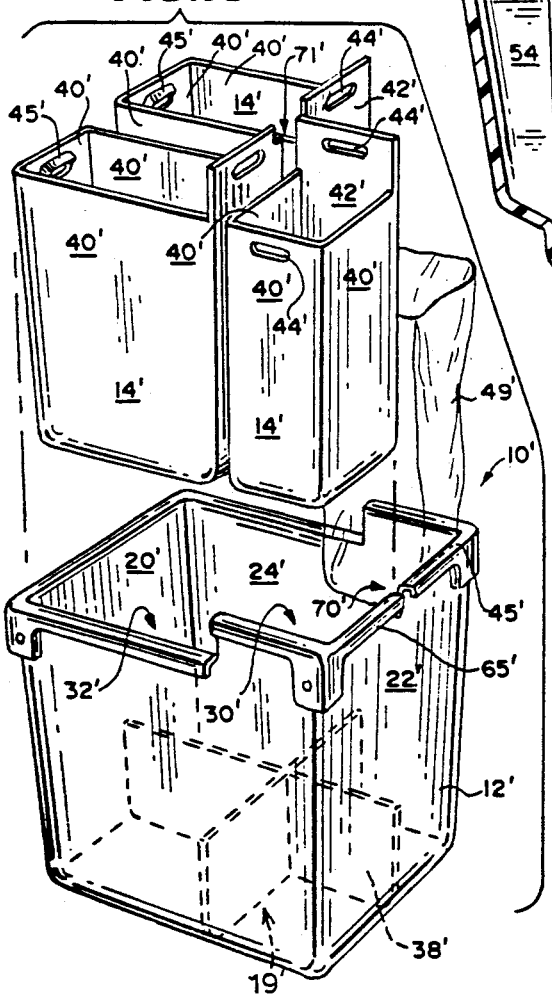
FIG. 10 is an exploded perspective view of an alternate embodiment of the unit of the present invention.
Figure 11:
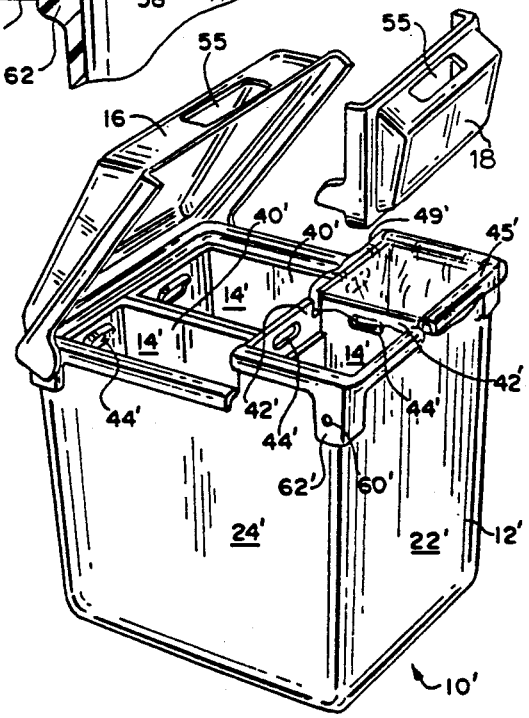
FIG. 11 is a perspective view of the alternate embodiment of FIG. 10.

The covers 16 and 18 each rotate about the stud 58, outwardly away from one another to a point where the rear lip portion 59 abuts against the respective corner boss 62, which positions the cover 16, 18 substantially as shown in FIGS. 3 and 9, which position is maintained by displacement of the center of gravity laterally outwardly of the stud 58, until the cover 16, 18 is manually closed by rotation about the stud 58.

Further, this extended position allows for ease in removing the liners 14 without need of removing the covers 16, 18.

Also, it will be noted that the top surface 45 of the walls 20, 22 and 24 of the container 12 are provided with a safety lip 65 which folds outwardly over and along the exterior wall surfaces of the container 12. This lip 65 forms a seat for the side and rear lip portions 59 and 60 of the covers 16 and 18. Further, the lip 65 forms an area of engagement for the trash bag 49 to be seated within the first storage area 30, with one edge of the trash bag 49 seating over the upwardly stepped walls 42 of the liners 14.

Although only the use of two liners 14 has heretofore been disclosed, this is not to be construed as limiting. In this respect an additional embodiment 10' of the invention which is very similar to the first embodiment, is shown in FIGS. 10, 11, 16 and 18. Here, a third liner 14' is added to store, if desired, a third recyclable material, such as plastic. The third liner 14' is merely inserted into the first storage area 30, dividing storage area 30 substantially in half.

The liner 14' includes a protruding wall 42, which extends to the same height as the back wall 22 of container 12. The liner 14' is dimensioned to fit snugly within the container 12. In this embodiment 10' the riser system 19' has been modified slightly as shown so that the second divider 38' extends across the extent of the container 12, thereby creating four chambers, rather than the three previously proposed.

In this embodiment 10' rear lip 65' is notched at 70' and contiguous corners 71' of each wall 42' of the liners 14 are notched as well. This notching has been provided for easing the engagement and removal of the trash bag 49' into and from the half of the area 30' provided for same.

Turning now to FIGS. 12–14, there is illustrated therein a further modified version of the liners 14'' wherein each upper edge thereof which abuts an area of the container 12'' is provided with a folded over lip 75, which nests over the lip 65 of the container 12. It will be understood that with such an arrangement, the liners 14'' will be held in place by the nesting of the lips 75'' and 65 and no riser system 19 will be required. The position of the liners 14'' is further maintained by abutment of one end 77'' of the lip 75'' against a vertical edge 79'' of the upwardly stepped area on each side wall 24 of the container 12.

Figure 16:
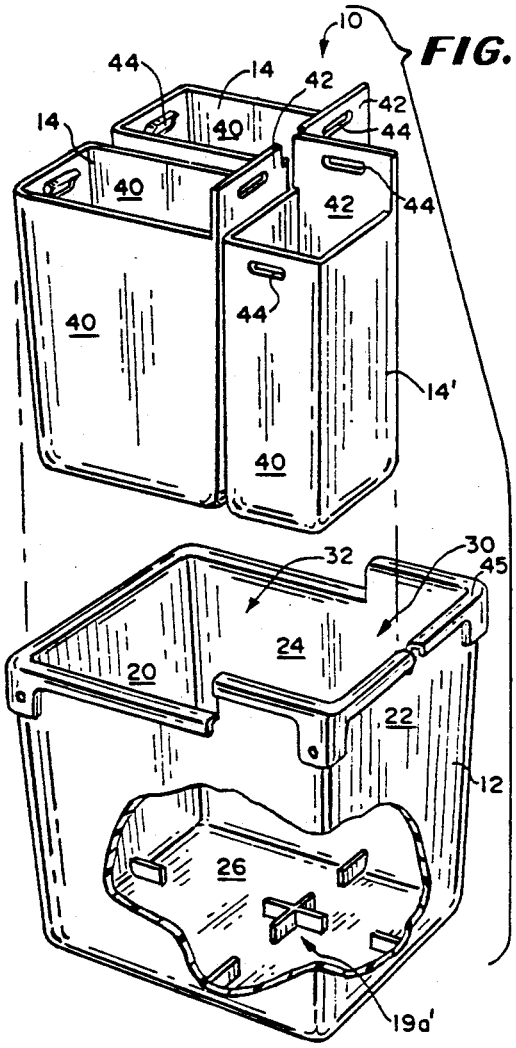
FIG. 16 is an exploded perspective view of the unit of FIG. 10 with portions broken away to show an alternate embodiment of the risers of the unit.

In FIGS. 15 and 16 modified versions 19*a* and 19'*a*, respectively, of the riser system 19 are shown.

Here, the sections 36 and 38 of the riser system 19 have been drastically decreased in vertical extent and have been horizontally divided as well, to illustrate possible alternate embodiments within the scope of the invention.

Figure 17:
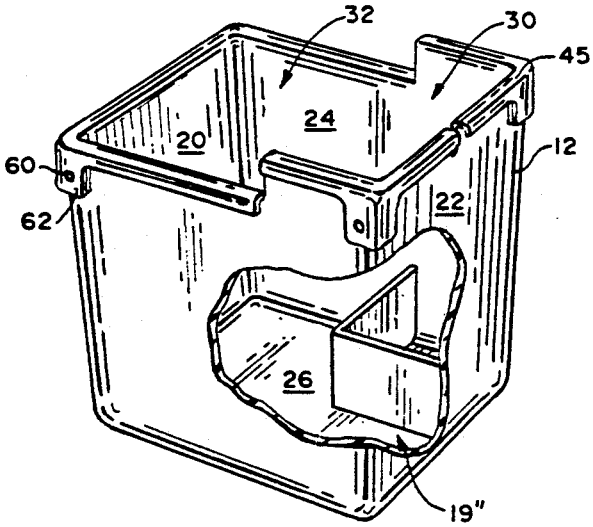
FIG. 17 is a perspective view of the unit of FIG. 10 with portions broken away to show a further embodiment of the risers of the unit.

FIG. 17 adds an even further variation for use with the unit 10 when three liners 14, 14' are provided, wherein the riser system 19'' now only provides a single L-shaped member 82 which creates a periphery only around the area where the plastic garbage 49' will seat.

Figure 18:
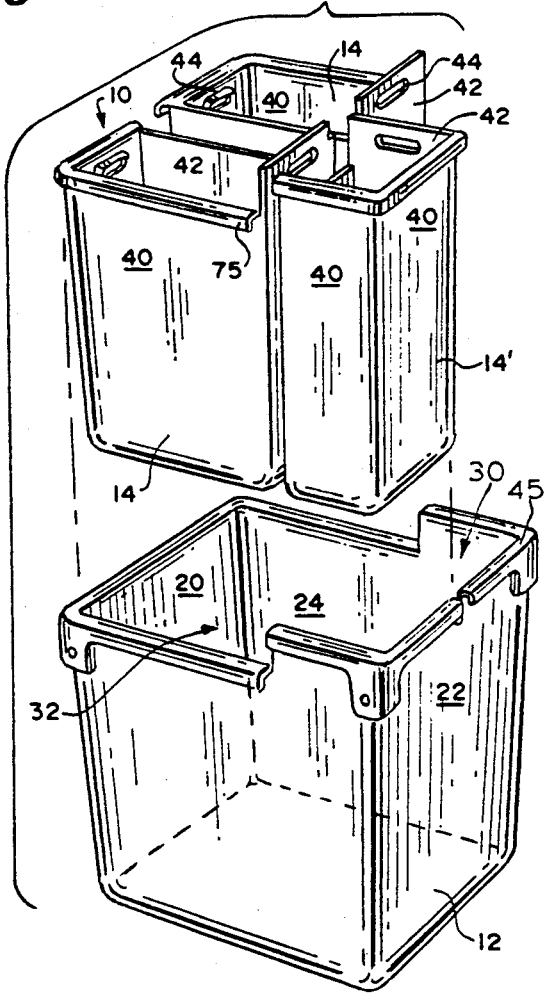
FIG. 18 is an exploded perspective view of the unit of FIG. 10 wherein the unit is shown without risers.

Finally, no riser system 19 would be required for a three liner 14, 14' unit as shown in FIG. 18, when the liners 14, 14' are all provided with lips 75, 75' which nest over the lips 65 on the container 12, securing the liners 14, 14' in place.

Figure 19:
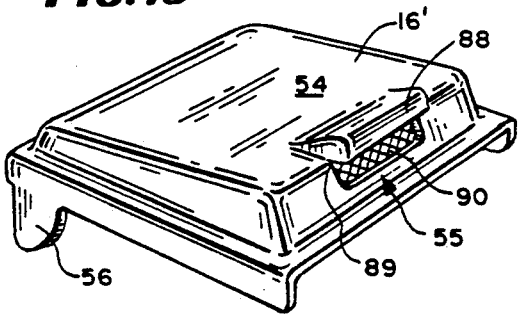
FIG. 19 is a perspective view of one cover of the unit.

In FIG. 19, there is disclosed a modified version 16' of a cover 16, 18 wherein a graspable handle 88 is incorporated along an upper edge 89 of the aperture 44. Further, if desired, the aperture 44 may include screening 90 thereacross for preventing flies and the like from entering the container 12 via the aperture 44.

In all embodiments disclosed, all corners of all structures are proposed to be rounded for safety.

The foregoing description is for the purposes of illustration only and does not limit the scope of protection which should be accorded this invention. The latter is to be measured by the following claims, which should be interpreted as broadly as the invention permits.

I claim:

1. A refuse collection unit for segregated collection of differing types of refuse, said unit comprising:

(a) a container body defining a first storage area and a second storage area shorter than said first storage area;

(b) said container body having a bottom wall, a front wall, a back wall higher than said front wall, and a pair of side walls having rearwardly, upwardly-stepped portions;

(c) said first storage area defined by said back wall and the upwardly-stepped portions of said side walls and said second storage area defined by said front wall and the remaining portions of said side walls;

(d) a plurality of rigid liners, each of which comprises a bottom wall, three side walls and an upwardly-stepped fourth wall; and (e) said rigid liners being removably received in a side-by-side relation within said second storage area such that the upwardly-stepped fourth walls thereof form a front wall for said first storage area.

2. The refuse collection unit of claim 1, wherein said back wall and said side walls of said container body and said upwardly stepped fourth walls of said rigid liners terminate in top surfaces and wherein a plastic refuse bag is removably secured in said first storage area by placing an edge portion of said plastic bag over said top surfaces.

3. The refuse collection unit of claim 2, wherein said container body bottom wall supports a riser system including at least a first divider and a second divider extending upwardly therefrom.

4. The refuse collection unit of claim 3, wherein said first divider separates said rigid liners disposed within said second storage area and said second divider separates said first storage area from said second storage area.

5. The refuse collection unit of claim 4, wherein said rigid liners include a lip on upper edges thereof which are sized and configured to nestedly seat over an edge formation on said container body.

6. The refuse collection unit of claim 5, wherein the container body engages a pair of covers, one of said covers covering said first storage and the other of said covers covering said second storage area.

7. The refuse collection unit of claim 6, wherein said covers comprise a cover portion, a pair of opposed side corner flanges, and a stud extending inwardly on each corner flange and wherein said container body includes two pairs of apertures, each pair of apertures receiving the studs of one of said covers therein.

8. A refuse collection unit for segregated collection of differing types of refuse, said unit comprising:

(a) a container body defining first and second storage areas therein, each area including a pivotal cover member therefor and each of said cover members being pivotally movable to an open position therefor in a direction away from the other cover member;

(b) said cover members in closed positions therefor lying in parallel planes; and (c) a pair of removable rigid liners each of which includes an upwardly stepped back wall, said stepped back walls, when placed coplanar within said second storage area of said container, separate the two storage areas from each other; and each rigid liner includes a hand-gripping means thereon for easy removal of the rigid liners from within the container body.

9. The refuse collection unit of claim 8 wherein a third liner of a size to occupy substantially one-half of said first storage area is placed within said first storage area.

* * * * *